United States Patent [19]

Kawamura et al.

[11] Patent Number: 4,535,045

[45] Date of Patent: Aug. 13, 1985

[54] ELECTRIC LIGHT-SENSITIVE MATERIAL CONTAINING A NOVEL VINYLIDENE CHLORIDE COPOLYMER

[75] Inventors: Kouichi Kawamura; Seiji Horie; Hideo Sato, all of Kanagawa, Japan

[73] Assignee: Fuji Photo Film Co., Ltd., Kanagawa, Japan

[21] Appl. No.: 548,813

[22] Filed: Nov. 4, 1983

[30] Foreign Application Priority Data

Nov. 5, 1982 [JP] Japan ..... 57-194199

[51] Int. Cl.[3] ..... G03G 5/05

[52] U.S. Cl. ..... 430/60; 430/62; 430/58

[58] Field of Search ..... 428/511; 430/625, 60, 430/62, 58

[56] References Cited

U.S. PATENT DOCUMENTS 4,007,148 2/1977 Ginter et al. ..... 428/511

4,197,129 4/1980 Muroi et al. ..... 430/625

*Primary Examiner*—John L. Goodrow

*Attorney, Agent, or Firm*—Sughrue, Mion, Zinn, Macpeak, and Seas

[57] ABSTRACT

An electrophotographic light-sensitive material is described. The material is comprised of an electrically conductive support and a light-sensitive layer on the support. The light-sensitive layer contains a copolymer comprising: (a) vinylidene chloride or vinyl chloride; (b) a vinyl based unsaturated monomer represented by the general formula: $CH_2=C(R_1)(R_2)$ (wherein the symbols are as defined in the appended claims); and (c) a vinyl monomer containing a hydroxyl group at the side chain thereof. This light-sensitive layer exhibits good adhesive properties, is superior in durability and moisture resistance, and produces images free from white spots and fog.

9 Claims, 5 Drawing Figures

ELECTRIC LIGHT-SENSITIVE MATERIAL CONTAINING A NOVEL VINYLIDENE CHLORIDE COPOLYMER

FIELD OF THE INVENTION

The present invention relates to an improved electrophotographic light-sensitive material, and more particularly, to an electrophotographic light-sensitive material having improved physical properties and capable of forming images of higher quality.

BACKGROUND OF THE INVENTION

An electrophotographic light-sensitive material usually comprises an electrically conductive support and a light-sensitive layer on the support. The light-sensitive layer is provided by coating a mixture of inorganic photoconductor e.g., zinc oxide, titanium oxide, cadmium sulfide, selenium, and an alloy of selenium and tellurium, or organic photo-semiconductor substances, e.g., polyvinyl carbazoles and arylamines, and a resin binder on a support. The layer may be provided by vacuum deposition. In recent years, a function separated type light-sensitive layer has been widely used in which the function of the photoconductor in the light-sensitive layer is separated; an electric charge-generating agent and an electric charge-transporting agent are used.

The function separated type light-sensitive layer as described above can be divided into two groups; (1) the light-sensitive layer is a single layer containing both the electric charge-generating agent and electric charge-transporting agent; and (2) the light-sensitive layer consists of an electric charge-generating layer containing the electric charge-generating agent and an electric charge-transporting layer containing the electric charge-transporting agent.

These electrophotographic light-sensitive materials, however, suffer from various problems because of poor affinity between the electrically conductive support and the light-sensitive layer; for example, the light-sensitive layer peels apart from the support because of poor adhesion therebetween, and white spots are formed in the formation of images.

In order to overcome the problems as described above, it has been proposed to divide the light-sensitive layer on the electrically conductive support into a photo-conductive layer and an intermediate layer, or to incorporate resins having good adhesive properties into the light-sensitive layer. For this purpose, various resins have been studied and developed. Typical examples are: (1) polyesters (described in, for example, Japanese Patent Application (OPI) No. 68848/82): (2) styrene-butadiene copolymers (described in, for example, Japanese Patent Application (OPI) No. 26739/79); (3) vinylidene chloride-acrylate copolymers (described in, for example, Japanese Patent Publication No. 12864/81); (4) vinyl chloride-vinyl acetate-ethylenic unsaturated acid copolymers (described in, for example, Japanese Patent Application (OPI) No. 47047/81); (5) polyurethane-polyamides (described in, for example, Japanese Patent Application (OPI) No. 114132/76); (6) polyvinyl butyral (described in, for example, Japanese Patent Publication No. 35823/75); (7) polyvinyl alcohol (described in, for example, Japanese Patent Application (OPI) No. 116345/82); and (8) vinylidene chloride-unsaturated monomer-polymerizable ethylenecarboxylic acid copolymers (described in, for example, Japanese Patent Application (OPI) No. 48555/79). The term "OPI" as used herein means a "published unexamined Japanese patent application".

For electrophotographic light-sensitive materials prepared using the resins as described above, the adhesion between the electrically conductive layer and the light-sensitive layer is improved to a certain extent, but other problems arise. For example, the residual potential is high, or although the residual potential is low at first, it is accumulated by repeated use. This causes a decrease in the contrast of images, or the formation of fog. Moreover, some of the electrophotographic light-sensitive materials have poor moisture resistance.

Another problem is that the electric chage retention rate in a diark place is poor.

Still another problem is that when the resins as described above are used in the preparation of an intermediate layer to be provided between the electrically conductive support and the photoconductive layer; in particular, when the photoconductive layer is provided by a coating procedure using organic solvents, the intermediate layer and the photoconductive layer intermingle, causing uneven coating and coating streaks, for example.

SUMMARY OF THE INVENTION

An object of the invention is to provide an electrophotographic light-sensitive material in which a light-sensitive layer is strongly bonded to an electrically conductive support, and which is superior in durability and moisture resistance and is further capable of forming sharp images free from white spots and fog.

Another object of the invention is to provide an electrophotographic light-sensitive material which is free from uneven coating and coating streaks.

It has been found that the objects can be attained by employing the copolymers of the present invention as described hereinafter as resins to be incoporated in the light-sensitive layer on the electrically conductive support.

The present invention relates to an electrophotographic light-sensitive material comprising an electrically conductive support and a light-sensitive layer on the support, wherein the light-sensitive layer contains a copolymer comprising: (a) vinylidene chloride or vinyl chloride; (b) a vinyl-based unsaturated monomer represented by the general formula (I) as described hereinafter; and (c) a vinyl monomer containing a hydroxyl group at the side chain thereto.

DETAILED DESCRIPTION OF THE INVENTION

Figure 1:
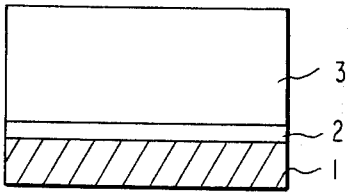
FIGS. 1 to 5 are each an enlarged schematic cross-sectional view of the electrophotographic light-sensitive material of the invention.

The copolymer as used herein is a copolymer containing monomers (a), (b) and (c) as described below:

(a) vinylidene chloride or vinyl chloride;

(b) a vinyl-based unsaturated monomer represented by the general formula (I):

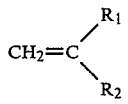

(I)

(wherein $R_1$ is a hydrogen atom or a methyl group, and $R_2$ is a cyano group, —$COOR_3$, —$OCOR_3$, —$OR_3$ or —$CONR_3R_4$ (wherein $R_3$ is an alkyl group containing 1 to 5 carbon atoms, an aryl group containing up to 15 carbon atoms, an allyl group, a vinyl group, or a heterocyclic group containing N, O or S atom, and $R_4$ is a hydrogen atom or an alkyl group containing 1 to 15 carbon atoms)); and (c) a vinyl monomer containing a hydroxyl group at the side chain thereof represented by the general formulas II and III:

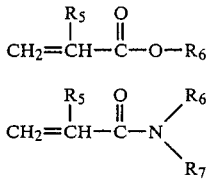

wherein $R_5$ represents a hydrogen atom or an alkyl group, $R_6$ represents an alkyl group, an aryl group, an aralkyl group or a substituted group of them, the group represented by $R_6$ containing a hydroxyl group, and $R_7$ represents a hydrogen atom, an alkyl group, an arylgroup, an aralkyl group or a substituted group of them.

Suitable preferred examples of the alkyl group, aryl group, and heteroaromatic group represented by $R_3$ and $R_4$ in the general formula (I) include a methyl group, an ethyl group, a propyl group, a hexyl group, a decyl group, a phenyl group, and a furan ring group.

The groups represented by $R_3$ and $R_4$ may be substituted by an alkyl group (e.g., a methyl group, an ethyl group, and a propyl group; preferably containing up to 6 carbon atoms), an aryl group (e.g., a phenyl group; preferably containing up to 10 carbon atoms), an alkoxyl group (e.g., a methoxy group, an ethoxy group, and a butoxy group; preferably containing up to 6 carbon atoms), a phenoxy group, a halogen atom (e.g. a chlorine atom and a bromine atom), a cyano group, an amino group and so forth.

Specific examples of the compounds represented by the general formula (I), i.e., the monomer (b), include acrylic acid, acrylic acid esters (e.g., methyl acrylate, ethyl acrylate, propyl acrylate, butyl acrylate, amyl acrylate, ethylhexyl acrylate, octyl acrylate, tert-octyl acrylate, 2-methoxyethyl acrylate, 2-butoxyethyl acrylate, 2-phenoxyethyl acrylate, chloroethyl acrylate, cyanoethyl acrylate, dimethylaminoethyl acrylate, benzyl acrylate, methoxybenzyl acrylate, furfuryl acrylate, tetrahydrofurfuryl acrylate, and phenyl acrylate), methacrylic acid, methacrylic acid esters (e.g., methyl methacrylate, ethyl methacrylate, propyl methacrylate, isopropyl methacrylate, amyl methacrylate, hexyl methacrylate, cyclohexyl methacrylate, benzyl methacrylate, cyanoacetoxyethyl methacrylate, chlorobenzyl methacrylate, octyl methacrylate, N-ethyl-N-phenyl-aminoethyl methacrylate, 2-methoxyethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, and naphthyl methacrylate), acrylonitrile, methacrylonitrile, vinyl ethers (e.g., methyl vinyl ether, butyl vinyl ether, hexyl vinyl ether, octyl vinyl ether, decyl vinyl ether, ethylhexyl vinyl ether, methoxyethyl vinyl ether, ethoxyethyl vinyl ether, chloroethyl vinyl ether, 1-methyl-2,2-dimethylpropyl vinyl ether, 2-ethylbutyl vinyl ether, dimethylaminoethyl vinyl ether, diethylaminoethyl vinyl ether, butylaminoethyl vinyl ether, benzyl vinyl ether, tetrahydrofurfuryl vinyl ether, vinyl phenyl ether, vinyl tolyl ether, vinyl chlorophenyl ether, vinyl 2,4-dichlorophenyl ether, vinyl naphthyl ether, and vinyl anthranyl ether), vinyl esters (e.g., vinyl acetate, vinyl propionate, vinyl butylate, vinyl isobutylate, vinyldimethyl propionate, vinylethyl butylate, vinyl varelate, vinyl caproate, vinyl chloroacetate, vinyl dichloroacetate, vinyl methoxyacetate vinylphenyl acetate, vinyl acetoacetate, vinyl lactate, vinyl-$\beta$-phenyl butylate, vinylcyclohexyl carboxylate, vinyl benzoate, vinyl salicylate, vinyl chlorobenzoate, and vinyl naphthoate), and acrylamides (e.g., acrylamide, N-methyl acrylamide, and N-n-butylacrylamide).

Preferred examples of the compounds represented by the general formula (I) include acrylonitrile, methyl acrylate, ethyl acrylate, methyl methacrylate, and ethyl methacrylate.

The vinyl monomer containing a hydroxyl group at the side chain thereof, i.e., the monomer (c), is represented by the following general formulas II and III:

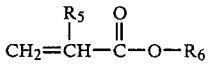

II

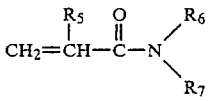

III wherein $R_5$ represents a hydrogen atom or an alkyl group having 1 to 4 carbon atoms, $R_6$ represents an alkyl group having 1 to 20 carbon atoms, an aryl group having 6 to 15 carbon atoms, an aralkyl group having 7 to 16 carbon atoms or a substituted group of them and the group represented by $R_6$ contains a hydroxyl group, and $R_7$ represents a hydrogen atom, an alkyl group having 1 to 20 carbon atoms, an aryl group having 6 to 15 carbon atoms, an aralkyl group having 7 to 16 carbon atoms or a substituted group of them.

The substituent for $R_6$ include a halogen atom, such as a chlorine atom, a bromine atom, etc., an alkoxy group having 1 to 15 carbon atoms, an aryl group having 6 to 10 carbon atoms, an aryloxy group having 6 to 10 carbon atoms, a carboalkoxy group having 2 to 15 carbon atoms or an alkyl group having 1 to 15 carbon atoms.

The substituent for $R_7$ include a hydroxyl group, a halogen atom, an alkoxy group having 1 to 15 carbon atoms, an aryl group having 6 to 10 carbon atoms or an alkyl group having 1 to 15 carbon atoms.

Preferred vinyl monomer containing a hydroxyl group at the side chain is a compound containing a polymerizable vinyl group and a hydroxyl group in the molecule. Examples are hydroxyethyl acrylate, hydroxyethyl methacrylate, 2-hydroxypropyl acrylate, 2-hydroxypropyl methacrylate, 3-chloro-2-hydroxypropyl acrylate, 3-chloro-2-hydroxypropyl methacrylate, 2,2-dimethylhydroxypropyl acrylate, 5-hydroxybezyl acrylate, diethylene glycol monoacrylate, trimethylolpropane monoacrylate, pentaerythritol monoacrylate, 2,2-dimethyl-3-hydroxypropyl methacrylate, 5-hydroxybenzyl methacrylate, diethylene glycol monomethacrylate, trimethylolpropane monomethacrylate, pentaerythritol monomethacrylate, hydroxymethylated-N(1,1-dimethyl-3-oxyobutyl)acrylamide, N-methylolacrylamide, N-methylolmethacrylamide N-ethyl-N-methylolacrylamide, N,N-dimethylolacrylamide, N-ethanolacrylamide, and N-propanolacrylamide. In addition, monomers producing a hydroxyl group during emulsion polymerization, such as glycidyl acrylate and glycidyl methacrylate, can be used.

Preferred examples are hydroxyethyl acrylate, hydroxyethyl methacrylate, and 2-hydroxypropyl methacrylate.

The copolymer of the present invention is sufficient to contain the monomers (a), (b) and (c), and may further contain other monomers, e.g., polymerizable ethylenic carboxylic acids such as itaconic acid, acrylic acid, methacrylic acid, maleic anhydride, and maleic acid. The additional amount of the other monomers is 10% by weight or less, based on the amount of the monomers.

It is preferred for the copolymer of the invention to comprise 35 to 96% by weight of the monomer (a), 0.5 to 40% by weight of the monomer (b), and 0.5 to 25% by weight of the monomer (c), based on the total amount of the monomers, although it is not limited thereto.

The copolymer of the present invention can be used in its usual solid form. In addition, it has a practical advantage that particularly when the copolymer is used in the preparation of the intermediate layer between the electrically conductive support and the light-sensitive layer, it can be coated without the use of organic solvents by using it in the form of a latex emulsified in water.

When the copolymer of the present invention is used in the form of latex, it is preferred that the copolymer comprise 75 to 90% by weight of the monomer (a), 1 to 24% by weight of the monomer (b), and 1 to 9% by weight of the monomer (c). If the monomer (a) content is more than 90% by weight, the stability of the latex is poor. If the monomer (c) content is less than 1% by weight, the adhesive properties of the latex are deteriorated. On the other hand, if the monomer (c) content is more than 9% by weight, the latex becomes easily coagulatable and the storage stability of the latex is reduced.

The copolymer of the present invention is superior in adhesion to the electrically conductive support and when used as an intermediate layer resin, does not intermingle with the upper layer, i.e., the photoconductive layer, not causing uneven coating and coating streaks at the coating of the photoconductive layer. This is believed to be due to the fact that since hydroxyalkyl methacrylate or hdyroxyalkyl acrylate is introduced into the vinylidene chloride-based polymer or vinyl chloride-based polymer, the OH group contained therein increases the adhesion strength and provides sufficient resistance against organic solvents used in the coating of the photoconductive layer. It is to be noted that the present invention is not limited by the theoretical consideration as described above.

Useful monomer compositions for the preparation of copolymers as used in the electrophotographic light-sensitive material of the invention are shown below. The term "part" is used herein to mean a weight ratio of each monomer.

EXAMPLE 1

(Monomer Components)

Vinylidene chloride (82 parts), methyl acrylate (9 parts), and 2-hydroxyethyl methacrylate (9 parts).

EXAMPLE 2

(Monomer Components)

Vinylidene chloride (85 parts), methyl acrylate (13 parts), and 2-hydroxyethyl methacrylate (2 parts).

EXAMPLE 3

(Monomer Components)

Vinylidene chloride (85 parts), methyl acrylate (10 parts), and 2-hydroxyethyl acrylate (5 parts).

EXAMPLE 4

(Monomer Components)

Vinylidene chloride (83 parts), methyl acrylate (12 parts), and 2-hydroxyethyl acrylate (5 parts).

EXAMPLE 5

(Monomer Components)

Vinylidene chloride (90 parts), methyl acrylate (9 parts), and 2-hydroxyethyl acrylate (1 part).

EXAMPLE 6

(Monomer Components)

Vinylidene chloride (85 parts), acrylonitrile (8 parts), and 2-hydroxyethyl acrylate (7 parts).

EXAMPLE 7

(Monomer Components)

Vinylidene chloride (90 parts), methyl acrylate (6 parts), and 2-hydroxypropyl methacrylate (4 parts).

EXAMPLE 8

(Monomer Components)

Vinylidene chloride (85 parts), methyl acrylate (9 parts), 2-hydroxyethyl acrylate (5 parts), and acrylic acid (1 part).

EXAMPLE 9

(Monomer Components)

Vinylidene chloride (85 parts), methyl acrylate (10 parts), and hydroxyethyl methacrylate (5 parts).

EXAMPLE 10

Vinylidene chloride (70 parts), butyl vinyl ether (20 parts), and N-methylolacrylamide (10 parts).

EXAMPLE 11

(Monomer Components)

Vinylidene chloride (85 parts), methyl acrylate (10 parts), and glycidyl acrylate (5 parts).

EXAMPLE 12

(Monomer Components)

Vinyl chloride (80 parts), acrylamide (10 parts), and 2-hydroxypropyl acrylate (10 parts).

EXAMPLE 13

(Monomer Components)

Vinylidene chloride (80 parts), vinyl acetate (10 parts), and 2-hydroxyethyl acrylate (10 parts).

EXAMPLE 14

(Monomer Components)

Vinyl chloride (80 parts), vinyl acetate (10 parts), and 2-hydroxyethyl acrylate (10 parts).

These copolymers may be those copolymers prepared by solution polymerizing in organic solvents according to the usual polymerization method, e.g., The Experimental Method described in T. Ohtsu, *Kobunshi Gosei No Jikkenho* (Experimentations for Polymer Synthesis), Kagaku Dojin Co., Ltd. (1972), or may be in the state of latex prepared by emulsion polymerizing in water according to the method described in Japanese Patent Application (OPI) No. 27519/74 corresponding to Japanese Patent Publication No. 15507/80.

The light-sensitive layer of the present invention may be composed of a photoconductive layer and an intermediate layer containing the copolymer as described above. In this case, the photoconductive layer may contain photosemiconductive substances, or may contain electric charge-generating and electric charge-transporting agents. When the electric charge-generating and electric charge-transporting agents are used, the photoconductive layer may be a single layer, or a multilayer consisting of the electric charge-generating and electron-transporting layers.

The copolymer of the present invention can be incorporated in any adjacent layer to the electrically conductive support (e.g., the photoconductive layer and the electric charge-generating layer), as well as in the intermediate layer as described above.

The electrophotographic material of the invention will hereinafter be explained in detail with reference to the accompanying drawings.

FIG. 1 is a schematic cross-sectional view of an electrophotographic light-sensitive material comprising an electrically conductive support 1, an intermediate layer 2 containing a copolymer of the invention on the support 1 and a photoconductive layer 3 on the intermediate layer 2, as a light-sensitive layer.

Figure 2:
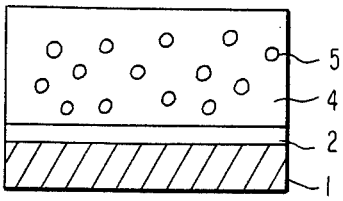

FIG. 2 is a schematic cross-sectional view of an electrophotographic light-sensitive material wherein the photoconductive layer 3 of FIG. 1 is composed of an electric charge-transporting agent 4 and an electric charge-generating agent 5 contained in the agent 4.

Figure 3:
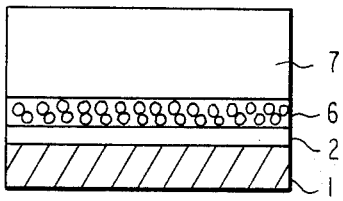

FIG. 3 is a schematic cross-sectional view of an electrophotographic light-sensitive material wherein the photoconductive layer 3 of FIG. 1 is composed of an electric charge-generating layer 6 an an electric charge-transporting layer 7.

Figure 4:
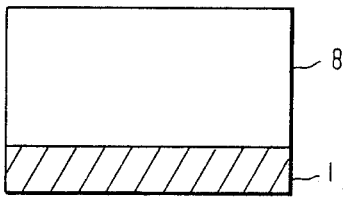

FIG. 4 is a schematic cross-sectional view of an electrophotographic light-sensitive material comprising an electrically conductive support 1 and a photoconductive layer 8 containing a copolymer of the invention, as a light-sensitive layer, on the support 1.

Figure 5:
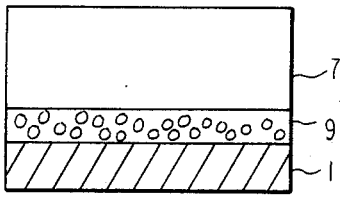

FIG. 5 is a schematic cross-sectional view of an electrophotographic light-sensitive material wherein a photoconductive layer containing a compound of the invention is composed of an electric charge-transporting layer 7 and an electric charge-generating layer 9 containing the copolymer as described above.

When the copolymer of the invention is used in the intermediate layer as shown in FIGS. 1 to 3, it is used singly or in combination with other components to prepare the intermediate layer. When the copolymer of the invention is used in combination with other components to prepare the intermediate layer, the copolymer content is usually 1% by weight or more and preferably 20% by weight or more.

Other components which can be used in combination with the copolymer of the invention include binders commonly used in electrophotographic light-sensitive materials and additionally, plasticizers as described in Japanese Patent Publication No. 46263/74, silane coupling agents as described in Japanese Patent Publication No. 19423/82, curing agents and/or crosslinking agents, Lewis acids as described in Japanese Patent Publication No. 19424/82, and electron-donating substances as described in Japanese Patent Publication No. 19782/82.

When the copolymer of the invention is used in the intermediate layer, it is preferred for the thickness of the intermediate layer to be $3\mu$ or less. If the thickness of the intermediate layer exceeds $3\mu$, the residual potential on the photoconductive layer after exposure increases, sometimes causing contamination of the image background. More preferably the thickness of the intermediate layer is from 0.01 to $1\mu$.

Solvents which can be used in coating the intermediate layer include ketones such as acetone, methyl ethyl ketone, and cyclohexanone, aromatic hydrocarbons such as benzene, toluene, and xylene, chlorinated hydrocarbons such as chloroform, dichloroethane, and methylene chloride, ethers such as tetrahydrofuran and dioxane, alcohols such as methanol, ethanol, and isopropanol, esters such as ethyl acetate and butyl acetate, and non-protonic polar solvents such as N,N-dimethylformamide and dimethylsulfoxide.

When the copolymer of the invention is a latex emulsified in water, water is used as a coating solvent.

When the copolymer of the invention is used in the photoconductive layer 8 as shown in Table 4, the copolymer content is from 0.5 to 90% by weight and preferably from 1.0 to 60% by weight. When the copolymer of the invention is used in the electric charge-generating layer as shown in FIG. 5, the copolymer content is from 0.5 to 95% by weight and preferably from 5 to 80% by weight.

Electrically conductive supports which can be used include metallic plates, and paper, plastic films, etc., which are made electrically conductive by coating, vacuum depositing, or laminating electrically conductive polymers, electrically conductive compounds such as indium oxide and tin oxide, or thin layers of, e.g., aluminum, palladium, nickel and gold.

The increase in adhesive strength due to the use of the copolymer of the invention is not influenced by the type and shape of the metal. Thus the metal may be in any of a vacuum deposited layer, a foil and a powder dispersion layer. The effect is significant particularly in the case of aluminum.

As photoconductive substances as used in the electrophotographic light-sensitive material of the invention, the inorganic and organic photoconductive substances as described above can be used. In addition, as other organic photoconductive substances, the compounds as described in Japanese Patent Application No. 101341/82 corresponding to U.S. Ser. No. 459,061 can be used.

Suitable examples of photoconductive substances include triazole derivatives, oxadiazole derivatives, imidazole derivatives, pyrazoline derivatives, polyaryl alkane compounds, phenylenediamine derivatives, hydrazone derivatives, amino-substituted chalcone derivatives, and N,N-bicarbazyl derivatives.

Although these inorganic or organic photoconductive substances are used singly, they are often used in admixture with the sensitizers as described in, for example, Japanese Patent Application (OPI) No. 46980/82 corresponding to U.S. Ser. No. 294,644, now U.S. Pat. No. 4,389,474 and Ser. No. 425,773 now U.S. Pat. No. 4,469,864, U.S. Pat. No. 3,619,154, and W. F. Berg et al., ed., *Current Problem of Electrophotography,* Water de Gruyter, Berlin (1972).

Suitable examples of such sensitizers include triphenylmethane dyes such as Brilliant Green, rhodamine dyes such as Rhodamine B, xanthene dyes such as Eosine and Rose Bengale, acridine dyes, cyanine dyes, pyrylium dyes, and additionally, 2,4,7-trinitrofluorenone, phthalic anhydride, tetraquinodimethane, and chloranil.

When the photoconductive layer is of the function separation type, the following electric charge-generating and electric charge-transporting agents can be used.

Inorganic electric charge-generating substances include cadmium sulfide, cadmium selenide, zinc oxide, zinc sulfide, titanium dioxide (particularly Lutile type), and selenium of trigonal system. Organic electric charge-generating substances include azo pigments such as Sudan Red, Chlorodiane Blue, and JANUS Green B, disazo pigments as described in, for example, Japanese Patent Publication No. 11945/81, Japanese Patent Application (OPI) No. 133445/78 corresponding to U.S. Pat. Nos. 4,242,260 and 4,272,598, and No. 2738/79, quinone pigments such as Algol Yellow, pyrenequinone, and Indanthrene Brilliant Violet RBP, indigo pigments such as Indigo and Thioindigo, bisbenzoimidazole pigments such as Indofast Orange Toner, phthalocyanine pigments such as Copper Phthalocyanine, and quinacridone pigments.

Electric charge-transporting agents can be divided into two groups; one is of the type that an electron is transferred and the other is of the type that a hole is transferred. Electron transferring media include electron attractive substances containing an electron attractive group, e.g., a cyano group, a nitro group, and a halogen group, such as tetracyanoquinodimethane, tetracyanoethylene, 2,4,7-trinitro-9-fluorenone, tetranitrofluorenone, trinitrontoluenone, and chloranylpromanyl. Hole transporting media include the organic photoconductive substances as described above. It is to be noted that the present invention is not intended to be limited to the electric charge-transporting agents as described above.

Any binder can be used in the electrophotographic light-sensitive material if it is desired to be used therein. It is preferred to use film-forming polymers which are hydrophobic, of high permittivity, and electrically insulating. Typical examples of such polymers are shown below although the present invention is not limited thereto.

(1) Polycarbonates
(2) Polyesters
(3) Methacryl resins
(4) Acryl resins
(5) Polyvinyl chloride
(6) Polyvinylidene chloride
(7) Polystrenes
(8) Polyvinyl acetate
(9) Styrene-butadiene copolymers
(10) Vinylidene chloride-acrylonitrile copolymers
(11) Vinyl chloride-vinyl acetate copolymers
(12) Vinyl chloride-vinyl acetate-maleic anhydride copolymers
(13) Silicone resins
(14) Silicone-alkyd resins
(15) Phenol-formaldehyde resins
(16) Styrene-alkyd resins
(17) Poly(N-vinyl)carbazole These binders can be used singly or as a mixture comprising two or more thereof.

The present invention is described in greater detail with reference to the following Examples and Comparative Example. Unless otherwise stated, quantities are expressed as parts by weight. However, the scope of the invention is not limited to these examples.

EXAMPLE 1

A latex of a copolymer comprising 85 parts of vinylidene chloride, 10 parts of methyl acrylate, and 5 parts of 2-hydroxyethyl acrylate (Compound Example (3)) was prepared and adjusted so that the solids content was 2% by weight. This latex was coated on a 100μ thick polyester film with an aluminum layer vacuum deposited thereon and dried at 100° C. for 5 minutes to form a 0.7μ thick intermediate layer.

A dispersion prepared by dispersing 1 part of a disazo pigment, Chlorodiane Blue, having the formula as described below in 0.4 parts of polyvinyl butyral and 50 parts of tetrahydrofuran (THF) was coated on the intermediate layer as formed above by means of a rod bar to form a 1μ thick electric charge-generating layer.

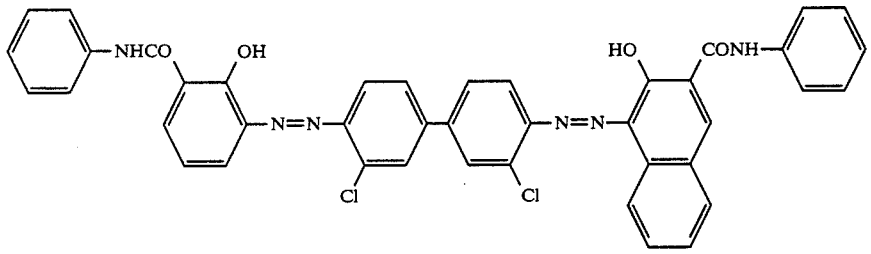

A solution of 2 parts of p-(diphenylamino)benzaldehyde-N'-methyl-N'-phenylhydrazone having the formula as shown below and 2 parts of polycarbonate (trade name: Lexane 121, produced by Plastic Engineering Co., Ltd.) dissolved in 60 parts of dichloromethane was coated on the electric charge-generating layer as formed above by means of a rod bar to form a 29μ thick electric charge-transporting layer.

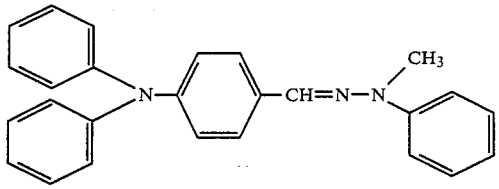

In this way, an electrophotographic light-sensitive material comprising the intermediate layer, the electric charge-generating layer, and the electric charge-transporting layer as illustrated in FIG. 3 was obtained.

The electrophotographic light-sensitive material thus prepared was free from unevenness of coating and coating streaks, was uniform, exhibited high adhesive properties, was scarecely affected by a bending test, and was rated as Class A by a peeling test as described below.

The peeling test was performed as follows:

Seven lines were cut in the light-sensitive material to be tested at 5 mm intervals in each of horizontal and vertical direction to form 30 squares. An adhesive tape was stuck onto the light-sensitive material and peeled apart in a 180° direction quickly. The rating was made as follows:

Class A: Areas not peeled apart constitute 90% or more of the total area.

Class B: Areas not peeled apart constitute 60–90% of the total area.

Class C: Areas not peeled apart constitute less than 60% of the total area.

Then the light-sensitive material was charged for 15 seconds at a charging voltage of −5.5 kV by means of Model SP-428 electrostatic tester (manufactured by Kawaguchi Denki Seisakujo Co., Ltd.) and allowed to stand for 1 minute in a dark place. At the end of the time, the surface potential ($V_1$) was measured and found to be −1260 V. The light-sensitive material was further allowed to stand in a dark place for 30 seconds. At the end of the time, the surface potential ($V_0$) was measured and found to be −1200 V. Thus the value of $V_0/V_1$ (electric charge retention rate) was 0.95.

The light-sensitive material was irradiated with tungsten light and the exposure amount (half-decay exposure amount $E_{50}$) required for decaying the surface potential to one-half of the original value was measured and found to be 4.3 lux.sec. The potential (residual potential, $V_R$) after the application of an exposure amount of 60 lux.sec was −30 volts.

The light-sensitive material was mounted onto a commercially available copying machine and a copying operation was performed. The image thus obtained was free from white spots and fog. The copying operation was repeated 1,000 times under the same conditions as above with the production of images of the same quality as at the initial stage.

COMPARATIVE EXAMPLE

Electrophotographic light-sensitive materials were prepared in the same manner as in Example 1 except that the intermediate layer was formed using the polymers as shown in Table 1, and evaluated with the results as shown in Table 1.

TABLE 1

| Comparative Sample No. | Polymer | Thickness of Intermediate Layer (μ) | Peeling Test | Coating Streaks | Electric Charge Retention Rate ($V_0/V_1$) | Residual Potential ($V_R$) | Repeated Copying |
|---|---|---|---|---|---|---|---|
| 1 | Polyester (Bayron 200) | 0.8 | Class B | Not formed | 0.50 | Impossible to test | Impossible to test |
| 2 | Styrene-Butadiene Copolymer (Sorprene 303) | 0.5 | Class A | Formed | 0.93 | −60 | Formation of fog and streaks |
| 3 | Polyurethane (Paraprene 16) | 0.3 | Class A | Formed | 0.90 | −50 | Formation of fog and streaks |
| 4 | Polyvinyl butyral (Denka Butyral) | 0.6 | Class B | Formed | 0.92 | −200 | Formation of fog |
| 5 | Copolymer of vinylidene chloride/methyl acrylate/acrylic acid (85/13/2) | 0.5 | Class A | Formed | 0.95 | −40 | Formation of streaks |

As can be seen from Table 1, there was obtained no light-sensitive material meeting all the requirements; materials exhibiting good adhesive properties and free from coating streaks were inferior in the electric charge retention rate, whereas materials having a high electric charge retention rate had disadvantages in other respects.

EXAMPLE 2

Electrophotographic light-sensitive materials were prepared in the same manner as in Example 1 except that the intermediate layer was formed using the copolymers of the invention as shown in Table 2, and evaluated in the same manner as in Example 1 with the results as shown in Table 2.

TABLE 2

| Copolymer | Thickness of Intermediate Layer (μ) | Peeling Test | Coating Streaks | Electric Charge Retention Rate ($V_0/V_1$) | Residual Potential $V_R$ | Repeated Copying (1,000 times) |
|---|---|---|---|---|---|---|
| Compound Example (1) | 0.4 | Class A | Not formed | 0.93 | −44 | No change |
| Compound Example (8) | 0.2 | Class A | Not formed | 0.95 | −30 | No change |

TABLE 2-continued

| Copolymer | Thickness of Intermediate Layer (μ) | Peeling Test | Coating Streaks | Electric Charge Retention Rate ($V_0/V_1$) | Residual Potential $V_R$ | Repeated Copying (1,000 times) |
|---|---|---|---|---|---|---|
| Compound Example (14) | 1.3 | Class A | Not formed | 0.90 | −72 | No change |

Note:
Compound Example (1): Copolymer of vinylidene chloride/methyl acrylate/2-hydroxyethyl methacrylate (82/9/9)
Compound Example (8): Copolymer of vinylidene chloride/methyl acrylate/2-hydroxyethyl acrylate/acrylic acid (85/9/5/1)
Compound Example (14): Copolymer of vinyl chloride/vinyl acetate/2-hydroxyethyl acrylate (80/10/10)

As can be seen from Table 2, the electrophotographic light-sensitive materials prepared using the copolymers of the invention are superior in all the adhesive properties, coating properties, electric charge retention rate, repeated copying properties, and residual potential value.

EXAMPLE 3

A latex of a copolymer (Compound Example (5)) comprising 90 parts of vinylidene chloride, 9 parts of methyl acrylate, and 1 part of 2-hydroxyethyl acrylate was prepared and adjusted so that the solids content was 2% by weight.

This latex was coated on an electrically conductive support prepared by vacuum depositing indium oxide on a polyester film and, thereafter, was dried at 100° C. for 5 minutes to form a 0.5μ thick intermediate layer.

A coating liquid was prepared by adding 1 part of Chlorodiane Blue, 5 parts of 4,4'-bis(diethylamino)-2,2'-dimethyltriphenylmethane, and 5 parts of polycarbonate (Lexane 121) to 95 parts of dichloromethane and pulverizing the mixture in a ball mill. This coating liquid was coated on the intermediate layer as formed above by means of a rod bar and dried to form a photoconductive layer.

In this way, an electrophotographic light-sensitive material as shown in FIG. 2 was prepared. The dry thickness of the material was 10μ.

The electrophotographic light-sensitive material exhibited good adhesive properties (the peeling test: Class A). When the light-sensitive material was mounted on a commercially available copying machine and a copying operation was performed, there was obtained an image free from white spots and fog. Even after the operation was repeated 1,000 times, there was obtained an image of the same quality as at the initial stage.

EXAMPLE 4

Electrophotographic light-sensitive materials were prepared in the same manner as in Example 2 except that as the electrically conductive support a polyethylene terephthalate film with palladium vacuum deposited thereon or a polyethylene terephthalate film with a dispersion of tin oxide in gelatin coated thereon was used.

These light-sensitive materials exhibited good adhesive properties (the peeling test: Class A) and, even after repeated copyings, could produce a good quality image.

EXAMPLE 5

A mixture of 1 g of poly(N-vinyl)carbazole, 2.50 mg of 2,6-di-tert-butyl-4-[4-(N-ethyl-N-2-chloroethylamino)styryl]thiopyrylium fluoroborate, and 20 mg of a copolymer (Compound Example (6)) comprising 85 parts of vinylidene chloride, 8 parts of acrylonitirle and 7 parts of 2-hydroxyethyl acrylate was dissolved in 15 ml of 1,2-dichloroethane. The solution thus prepared was coated on a 100 μm thick polyethylene terephthalate film with indium oxide vacuum deposited thereon by means of a rod bar and dried at 55° C. for 2 hours to prepare a light-sensitive material as illustrated in FIG. 4. The thickness of the photoconductive layer was 5 μm.

The electrophotographic light-sensitive material as prepared above exhibited good adhesive properties (the peeling test: Class A) and, even after repeated copyings, could produce a good quality image.

EXAMPLE 6

A mixture of 100 mg of a copolymer (Compound Example (9)) comprising 85 parts of vinylidene chloride, 10 parts of methyl acrylate, and 5 parts of hydroxyethyl methacrylate and 100 mg of copper phthalocyanine was added to 10 ml of THF and pulverized in a ball mill for 30 minutes.

The solution thus prepared was coated on a 100μ thick polyester film with aluminum vacuum-deposited thereon by means of a rod bar to form a 1μ thick electric charge-generating layer.

A solution of 2 parts of 4,4'-bis(diethylamino)-2,2'-dimethyltriphenylmethane and 2 parts of polycarbonate dissolved in 60 parts of dichloromethane was further coated on the electric charge-generating layer as formed above to form 20μ thick electric charge-transporting layer.

In this way, an electrophotographic light-sensitive material as illustrated in FIG. 5 was prepared.

For the light-sensitive material thus prepared, the adhesive properties as determined by the peeling test were Class A, the half-decay exposure amount $E_{50}$ was 2.8 lux.sec, the residual potential $V_R$ was −40 volts, and the electric charge retention rate was 0.98. When the light-sensitive material was mounted on a commercially available copying machine and a copying operation was conducted, there was obtained a good quality image. Even after repeated copyings, the light-sensitive material produced a good quality image.

While the invention has been described in detail and with reference to specific embodiment thereof, it will be apparent to one skilled in the art that various changes and modifications can be made therein without departing from the spirit and scope thereof.

What is claimed is:

1. An electrophotographic light-sensitive material comprising an electrically conductive support and a light-sensitive layer on the support, wherein the light-sensitive layer contains a copolymer comprising:

(a) a monomer selected from the group consisting of a vinylidene chloride and a vinyl chloride;

(b) a vinyl-based unsaturated monomer represented by the general formula;

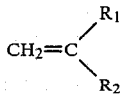

I (wherein $R_1$ is a hydrogen atom or a methyl group, and $R_2$ is a cyano group, $—COOR_3$, $—OCOR_3$, $—OR_3$ or $—CONR_3R_4$ (wherein $R_3$ is an alkyl group containing from 1 to 15 carbon atoms, an aryl group containing up to 15 carbon atoms, an allyl group, a vinyl group, or a heterocyclic group, and $R_4$ is a hydrogen atom or an alkyl group containing from 1 to 15 carbon atoms)); and (c) a vinyl monomer containing a hydroxyl group at the side chain thereof represented by the general formulas II and

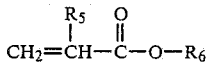

II

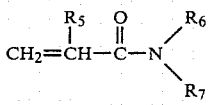

III wherein $R_5$ represents a hydrogen atom or an alkyl group, $R_6$ represents an alkyl group, an aryl group, an aralkyl group or a substituted group of them, the group represented by $R_6$ containing a hydroxyl group, and $R_7$ represents a hydrogen atom, an alkyl group, an aryl group, an aralkyl group or a substituted group of them.

2. The electrophotographic light-sensitive material as claimed in claim 1, wherein the light-sensitive layer comprises an intermediate layer and a photoconductive layer, said intermediate layer containing the copolymer.

3. An electrophotographic light-sensitive material as claimed in claim 1, wherein the (b) vinyl-based unsaturated monomer is selected from the group consisting of acrylonitrile, methyl acrylate, ethyl acrylate, methyl methacrylate, and ethyl methacrylate.

4. An electrophotographic light-sensitive material as claimed in claim 1, wherein $R_5$ represents a hydrogen atom or an alkyl group having 1 to 4 carbon atoms, $R_6$ represents an alkyl group having 1 to 20 carbon atoms, an aryl group having 6 to 15 carbon atoms, an aralkyl group having 7 to 16 carbon atoms or a substituted group of them and the group represented by $R_6$ contains a hydroxyl group, and $R_7$ represents a hydrogen atom, an alkyl group having 1 to 20 carbon atoms, an aryl group having 6 to 15 carbon atoms, an aralkyl group having 7 to 16 carbon atoms or a substituted group of them.

5. An electrophotographic light-sensitive material as claimed in claim 1, wherein the (c) vinyl monomer containing a hydroxyl group at the side chain thereof is selected from the group consisting of hydroxyethyl acrylate, hydroxyethyl methacrylate, and 2-hydroxypropyl methacrylate.

6. An electrophotographic light-sensitive material as claimed in claim 1, wherein the copolymer is comprised of 35 to 96% by weight of the monomer (a), 0.5 to 40% by weight of the monomer (b), and 0.5 to 25% by weight of the monomer (c).

7. An electrophotographic light-sensitive material as claimed in claim 1, wherein the copolymer is present on the support in the form of a latex, the copolymer being comprised of 75 to 90% by weight of the monomer (a), 1 to 24% by weight of the monomer (b), and 1 to 9% by weight of the monomer (c).

8. The electrophotographic light-sensitive material as claimed in claim 1, wherein the light-sensitive layer comprises a charge generating layer and a charge transporting layer, said charge generating layer containing the copolymer claimed in claim 1.

9. The electrophotographic light-sensitive material as claimed in claim 1, wherein the light-sensitive layer comprises a photoconductive layer, said photoconductive layer containing the copolymer claimed in claim 1.

* * * * *